US011905773B2

(12) United States Patent
Atkins et al.

(10) Patent No.: US 11,905,773 B2
(45) Date of Patent: Feb. 20, 2024

(54) SECURING AN INTERNAL ASSEMBLY WITHIN A TOOL

(71) Applicant: Schlumberger Technology Corporation, Sugar Land, TX (US)

(72) Inventors: James Edward Atkins, Aberdeen (GB); Seweryn Wrozyna, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/904,134

(22) PCT Filed: Feb. 14, 2020

(86) PCT No.: PCT/US2020/018221
§ 371 (c)(1),
(2) Date: Aug. 12, 2022

(87) PCT Pub. No.: WO2021/162698
PCT Pub. Date: Aug. 19, 2021

(65) Prior Publication Data

US 2023/0078402 A1 Mar. 16, 2023

(51) Int. Cl.
*E21B 23/00* (2006.01)

(52) U.S. Cl.
CPC ..... *E21B 23/00* (2013.01)

(58) Field of Classification Search
CPC ..... E21B 23/00; E21B 21/002
See application file for complete search history.

(56) References Cited

U.S. PATENT DOCUMENTS 4,655,290 A 4/1987 Smith, Jr.
4,722,390 A 2/1988 Smith, Jr.
5,333,685 A 8/1994 Gilbert
(Continued)

FOREIGN PATENT DOCUMENTS

WO 2019240835 A1 12/2019

OTHER PUBLICATIONS

International Search Report and Written Opinion in International Patent Application No. PCT/US2020/018221, dated Nov. 3, 2020, 12 pages.

*Primary Examiner* — Brad Harcourt
(74) *Attorney, Agent, or Firm* — Jeffrey D. Frantz

(57) ABSTRACT

A tool includes an internal assembly configured to be positioned at least partially within a body. The tool also includes a collet configured to be positioned at least partially within the body and axially-adjacent to the internal assembly. The collet includes a plurality of fingers that are circumferentially-offset from one another. At least one of the fingers includes a protrusion that extends radially-outward and is configured to be positioned at least partially within a recess formed in an inner surface of the body to secure the collet in place with respect to the body. The tool also includes a collet pin configured to be positioned at least partially within the body, axially-adjacent to the internal assembly, and at least partially within the collet. The collet pin is configured to contact the internal assembly to secure the internal assembly in place within the body.

17 Claims, 9 Drawing Sheets

(56) References Cited

U.S. PATENT DOCUMENTS

| | | | | |
|---|---|---|---|---|
| 7,063,175 | B1 * | 6/2006 | Kerstetter | E21B 17/03 175/320 |
| 7,373,974 | B2 * | 5/2008 | Connell | E21B 17/06 166/242.6 |
| 7,931,085 | B2 * | 4/2011 | Moyes | E21B 17/06 166/301 |
| 8,453,724 | B2 * | 6/2013 | Zhou | E21B 31/08 166/99 |
| 9,976,349 | B2 * | 5/2018 | Altimas | E21B 4/02 |
| 2011/0042107 | A1 | 2/2011 | Chambers et al. | |
| 2015/0129307 | A1 * | 5/2015 | Pope | E21B 47/01 175/40 |
| 2016/0281429 | A1 * | 9/2016 | Wilson | E21B 4/003 |
| 2021/0017834 | A1 * | 1/2021 | Sundarraj | E21B 23/06 |

* cited by examiner

SECURING AN INTERNAL ASSEMBLY WITHIN A TOOL

BACKGROUND

Downhole tools oftentimes have one or more internal assemblies positioned therein. More particularly, the downhole tool may include a body defining an internal volume. For example, the body may have a bore formed at least partially therethrough. The internal assembly may be positioned at least partially within the internal volume (e.g., the bore). The internal assembly may be or include any component that may be run downhole in the downhole tool, such as, for example, a measurement tool, a filter tool, a battery, or the like. The internal assembly may be secured to the body (e.g., within the bore) to prevent the internal assembly from moving freely within the body, which may damage the internal assembly. Oftentimes, the internal assembly may be secured to the body by threads or bolts. However, sometimes, the internal assembly cannot be threaded or bolted to the body, and another way to secure the internal assembly may be useful.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A tool is disclosed. The tool includes an internal assembly configured to be positioned at least partially within a body. The tool also includes a collet configured to be positioned at least partially within the body and axially-adjacent to the internal assembly. The collet includes a plurality of fingers that are circumferentially-offset from one another. At least one of the fingers includes a protrusion that extends radially-outward and is configured to be positioned at least partially within a recess formed in an inner surface of the body to secure the collet in place with respect to the body. The collet also includes inner threads on an inner surface thereof. The tool also includes a collet pin configured to be positioned at least partially within the body, axially-adjacent to the internal assembly, and at least partially within the collet. The collet pin includes outer threads on an outer surface thereof that are configured to engage the inner threads of the collet to secure the collet pin in place with respect to the collet. The collet pin is configured to contact the internal assembly to secure the internal assembly in place within the body.

A collecting tool is also disclosed. The collecting tool includes a substantially tubular body defining an axial bore. The bore is configured to have a drilling fluid flow therethrough. An internal assembly is configured to be positioned at least partially within the bore. The internal assembly includes a magnet holder and a plurality of magnets positioned at least partially within the magnet holder. The magnets are configured to attract magnetic debris in the drilling fluid. A collet is configured to be positioned at least partially within the bore and axially-adjacent to the internal assembly. The collet includes a plurality of fingers that are circumferentially-offset from one another. At least one of the fingers includes a protrusion that extends radially-outward and is configured to be positioned at least partially within a recess formed in an inner surface of the body to secure the collet in place with respect to the body. The collet further includes inner threads on an inner surface thereof. A collet pin is configured to be positioned at least partially within the bore, axially-adjacent to the internal assembly, and at least partially within the collet. The collet pin includes outer threads on an outer surface thereof that are configured to engage the inner threads of the collet to secure the collet pin in place with respect to the collet. The collet pin is configured to contact the internal assembly to secure the internal assembly in place within the body.

A method for assembling and/or using a tool is also disclosed. The method includes inserting an internal assembly into a body of the tool. The method also includes inserting a collet into the body. The collet is positioned axially-adjacent to the internal assembly. A protrusion on the collet is positioned at least partially within a recess in an inner surface of the body to secure the collet in place within the body. The method also includes inserting a collet pin into the body. The collet pin is positioned axially-adjacent to the internal assembly and at least partially within the collet. The method also includes inserting a collet tool at least partially into the body. The method also includes engaging the collet with the collet tool. The method also includes inserting a collet pin tool at least partially into the body. The method also includes engaging the collet pin with the collet pin tool. The method also includes connecting the collet pin to the collet, using the collet tool and the collet pin tool, to secure the collet pin in place within the body.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Figure 1:
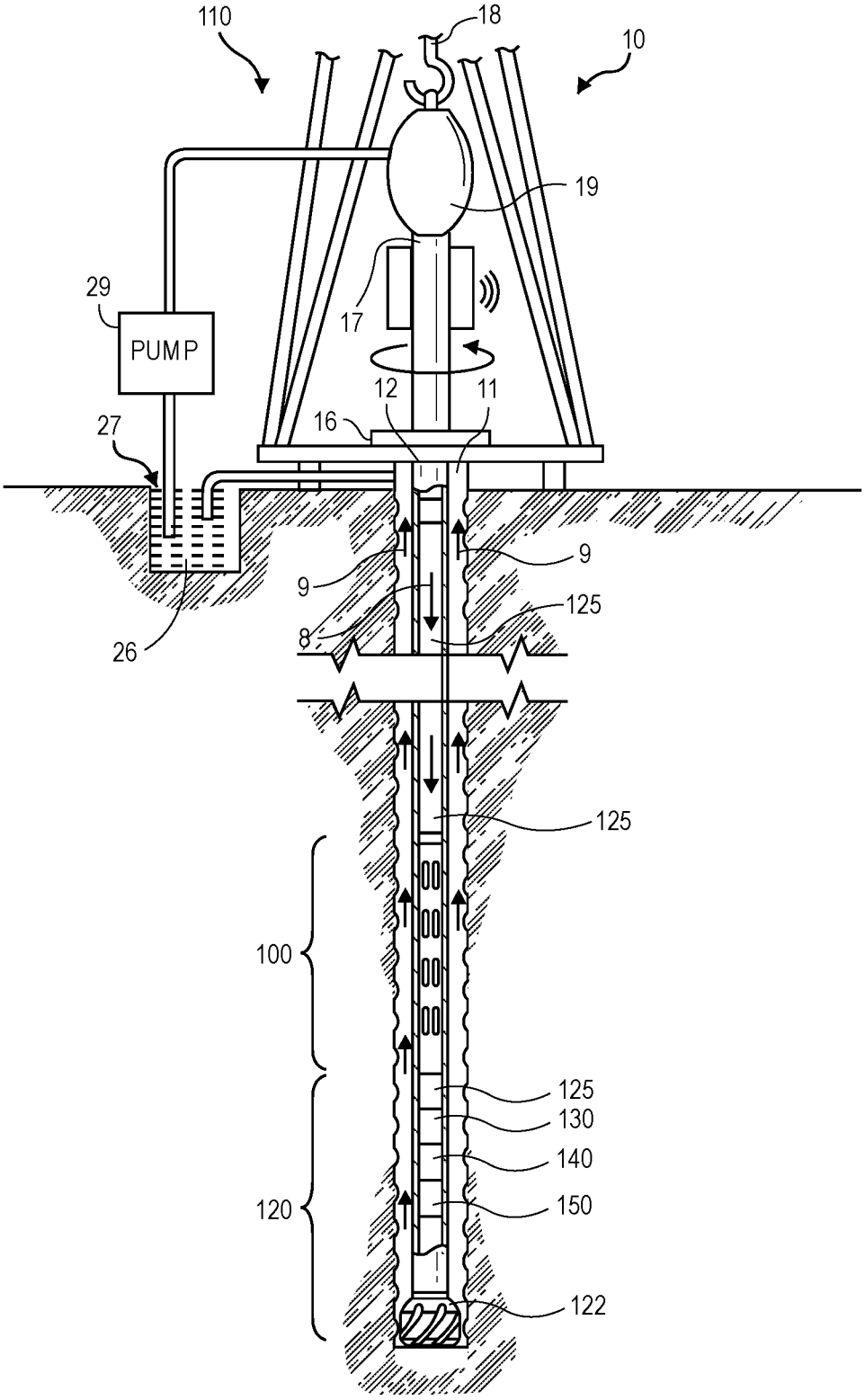
FIG. 1 illustrates a schematic view of an example of a drilling system, according to an embodiment.

FIG. 1 illustrates a schematic view of an example of a drilling system 110, according to an embodiment. The drilling system 110 may be provided at a wellsite which may be an onshore or offshore wellsite, and the drilling system 110 may include any combination of the various elements described herein.

The drilling system 110 may form a borehole 11 in a subsurface formation by rotary drilling with a drill string 12 suspended within the borehole 11. The drilling system 110 may include a platform and derrick assembly 10 positioned over the borehole 11. The platform and derrick assembly 10 may include a rotary table 16, a kelly 17, a hook 18, and/or a rotary swivel 19. The drill string 12 may be rotated by the rotary table 16, which engages the kelly 17 at the upper end of the drill string 12. The drill string 12 may be suspended from the hook 18, attached to a traveling block, through the kelly 17 and the rotary swivel 19, which permits rotation of the drill string 12 relative to the hook 18. In another embodiment, a top drive system may be utilized instead of the rotary table 16 and/or the kelly 17 to rotate the drill string 12 from the surface above the borehole 11. The drill string 12 may be assembled from a plurality of segments 125 that may be or include pipe and/or collars.

The drilling system 110 may also include a BHA 120 connected to a lower end of the drill string 12. The BHA 120 may include a logging-while-drilling (hereinafter "LWD") tool 130, a measuring-while-drilling (hereinafter "MWD") tool 140, a motor 150, a drill bit 122, or a combination thereof. The drilling system 110 may further include a drilling fluid or mud 26 (hereinafter "drilling fluid 26") stored in a pit 27 formed at the wellsite. A pump 29 may deliver the drilling fluid 26 to an interior of the drill string 12 via a port in the rotary swivel 19, which may cause the drilling fluid 26 to flow downwardly through the drill string 12 and the BHA 120, as indicated by the directional arrow 8. The drilling fluid 26 may exit via ports in the drill bit 122, and then circulate upwardly through an annulus between an outside of the drill string 12 and a wall of the borehole 11, as indicated by directional arrows 9. The drilling fluid 26 may lubricate the drill bit 122 and/or may carry formation cuttings up to the surface adjacent to the borehole 11. The drilling fluid 26 may by returned to the pit 27 for cleaning and recirculation.

The drilling system 110 may also include a tool 100, which may be run into the borehole 11 (e.g., on the drill string 12). For example, the tool 100 may be connected to the drill string 12, the BHA 120, or both. As described in greater detail below, the tool 100 may have an internal assembly positioned at least partially therein. In the embodiment described below, the internal assembly may be or include a filtering tool. More particularly, the internal assembly may be or include a magnetic filtering tool that is configured to separate magnetic, metallic, ferrous, and/or ferromagnetic debris (hereinafter "magnetic debris") from the drilling fluid 26. However, as will be appreciated, this is merely one example of an internal assembly, and the internal assembly may also or instead include other (e.g., non-magnetic and/or non-filtering) tools such as measurement tools, batteries, etc.

In the embodiment shown, the tool 100 may be positioned above and/or upstream from the BHA 120. If the magnetic debris enters the BHA 120, the magnetic debris may damage the BHA 120 and/or reduce the efficiency of the BHA 120. Thus, in one embodiment, the tool 100 may be configured to separate at least a portion of the magnetic debris from the drilling fluid 26, prior to the drilling fluid 26 flowing into the BHA 120. The tool 100 may collect and/or store the magnetic debris therein.

The magnetic debris that remains within the tool 100 may be removed or collected therefrom at the surface of the wellsite after the tool 100 has been pulled out of the borehole 11. In another embodiment, the magnetic debris that remains within the tool 100 may be removed or collected therefrom while the tool 100 is being pulled out of the borehole 11. In yet another embodiment, the magnetic debris that remains within the tool 100 may be removed or collected therefrom in the borehole 11 by one or more downhole tools and/or components.

As will be appreciated, collecting the magnetic debris in the tool 100 may prevent the magnetic debris or at least a portion of the magnetic debris from reaching and potentially damaging the BHA 120. In an embodiment, the tool 100 may minimize pressure loss across the drilling system 110 by collecting the magnetic debris. In another embodiment, the tool 100 may reduce or prevent the magnetic debris from interfering with any directional survey tools conducted in/by the BHA 120.

Figure 2:
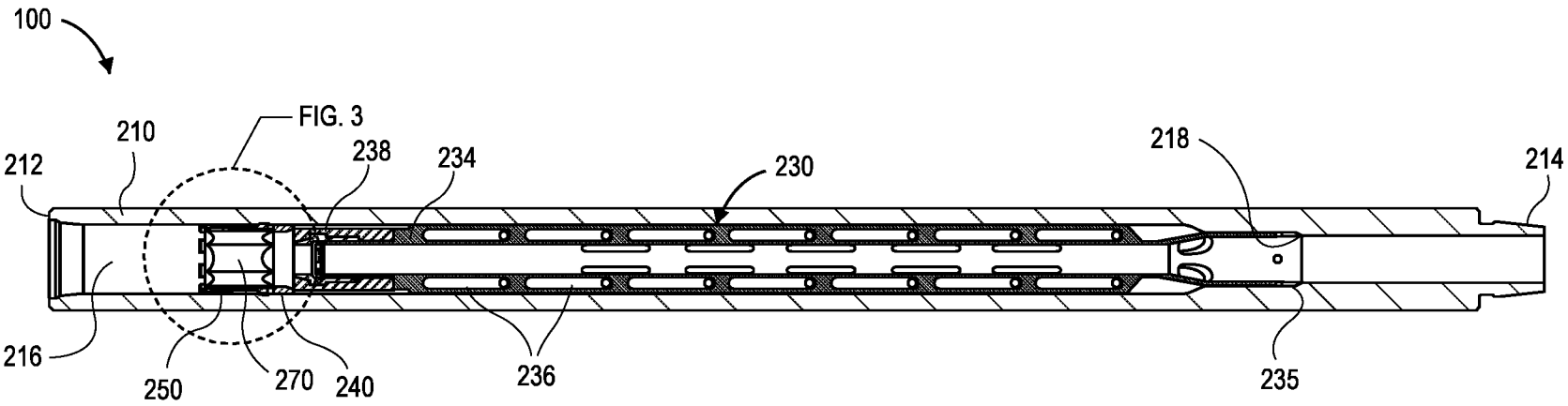
FIG. 2 illustrates a cross-sectional side view of an example of a tool in the drilling system, according to an embodiment.

FIG. 2 illustrates a cross-sectional side view of an example of the tool 100, according to an embodiment. The tool 100 may include a body 210 having a first (e.g., upstream) end 212 and a second (e.g., downstream) end 214. The first end 212 may be connected to a segment 125 of the drill string 12. The second end 214 may be connected to the BHA 120 or to a segment 125 of the drill string 12 that is positioned between the tool 100 and the BHA 120. The body 210 may define an axial bore 216 that extends from the first end 212 to the second end 214.

An internal assembly 230 may be positioned at least partially within the body 210 (e.g., within the bore 216). As mentioned above, while the following embodiment of the internal assembly 230 is configured to filter the magnetic debris from the drilling fluid 26, in other embodiments, the internal assembly 230 may also or instead include other (e.g., non-magnetic and/or non-filtering) tools such as measurement tools, batteries, etc.

In one embodiment, the internal assembly 230 may include a magnet holder 234. A lower end 235 of the internal assembly (e.g., the magnet holder 234) may be configured to contact an internal shoulder 218 formed on an inner surface of the body 210. This may prevent the internal assembly 230 from moving farther in the downstream direction (e.g., to the right in FIG. 2). A plurality of magnets 236 may be connected to, positioned within, or otherwise held by the magnet holder 234. The magnets 236 may be axially-offset and/or circumferentially-offset from one another. As described in greater detail below, the magnets 236 may be configured to attract magnetic debris in the drilling fluid 26. The internal assembly 230 may also include a sleeve 238 positioned at least partially around the magnet holder 234. The internal assembly 230 may also include an adapter 240 that is coupled to or positioned proximate to a first (e.g., upstream) end of the magnet holder 234 and/or the sleeve 238.

The drilling fluid 26 may flow down the drill string 12 and into the bore 216 of the body 210 via the first end 212 of the body 210. At least a portion of the magnetic debris in the drilling fluid 26 may be attracted by the magnets 236 and thus collected by/within the tool 100. The drilling fluid 26, with at least a portion of the magnetic debris separated/removed therefrom, may then be discharged from the bore 216 of the body 210 via the second end 214 of the body 210 and flow into the BHA 120.

Figure 3:
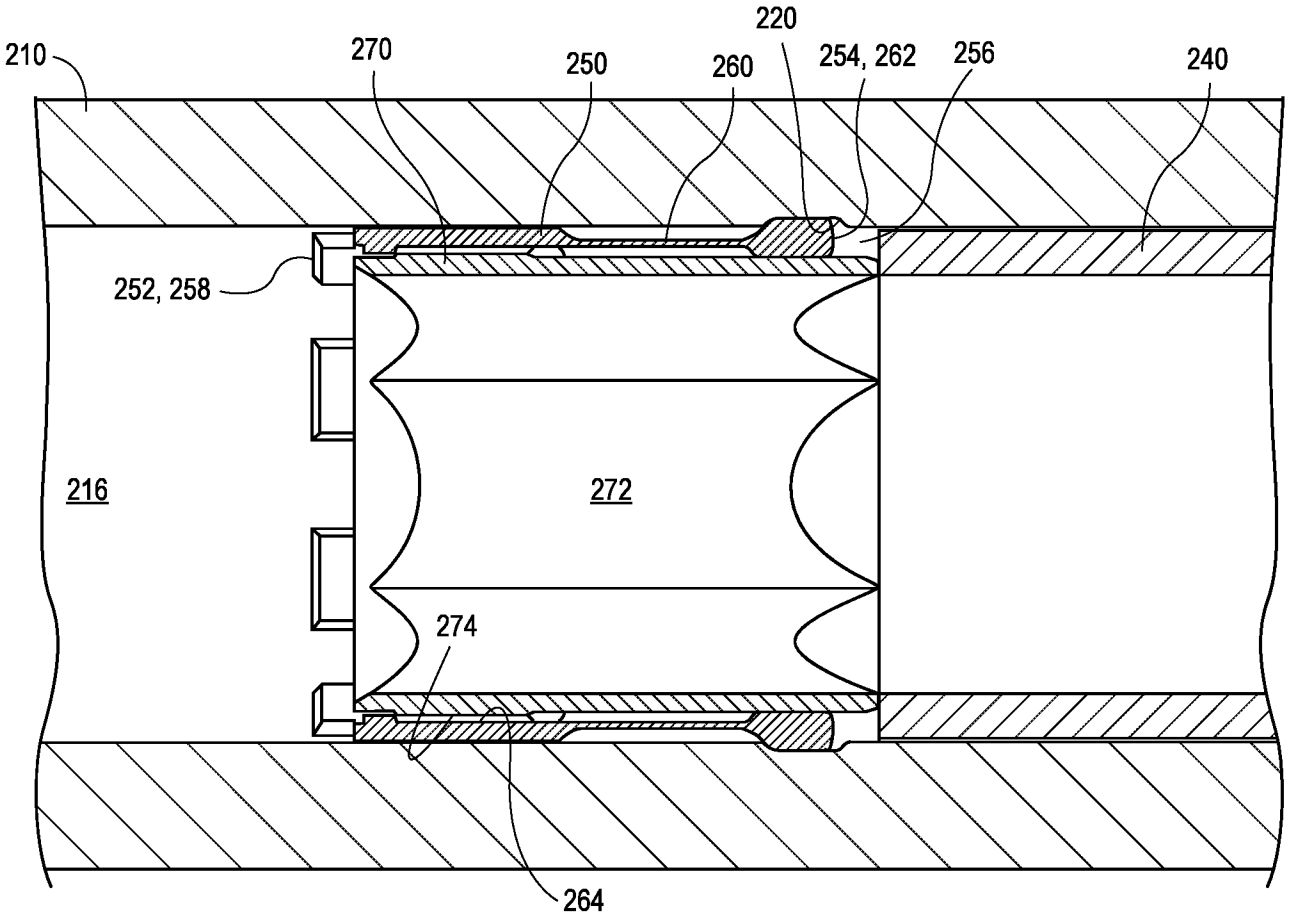
FIG. 3 illustrates an enlarged cross-sectional side view of a portion of FIG. 2, according to an embodiment.

FIG. 3 illustrates an enlarged portion of FIG. 2, according to an embodiment. Referring to FIGS. 2 and 3, a collet 250 may also be positioned at least partially within the body 210 (e.g., within the bore 216). The collet 250 may be or include an annular member that includes a first (e.g., upstream) end 252 and a second (e.g., downstream) end 254. The second end 254 may be positioned axially-adjacent to the internal assembly 230 (e.g., the adapter 240). As shown, an axial gap 256 may be present between the second end 254 of the collet 250 and the adapter 240. In another embodiment, the second end 254 may contact the adapter 240. In yet another embodiment, the adapter 240 may be omitted, and the second end 254 may contact the magnet holder 234 or the sleeve 238 directly.

Figure 4:
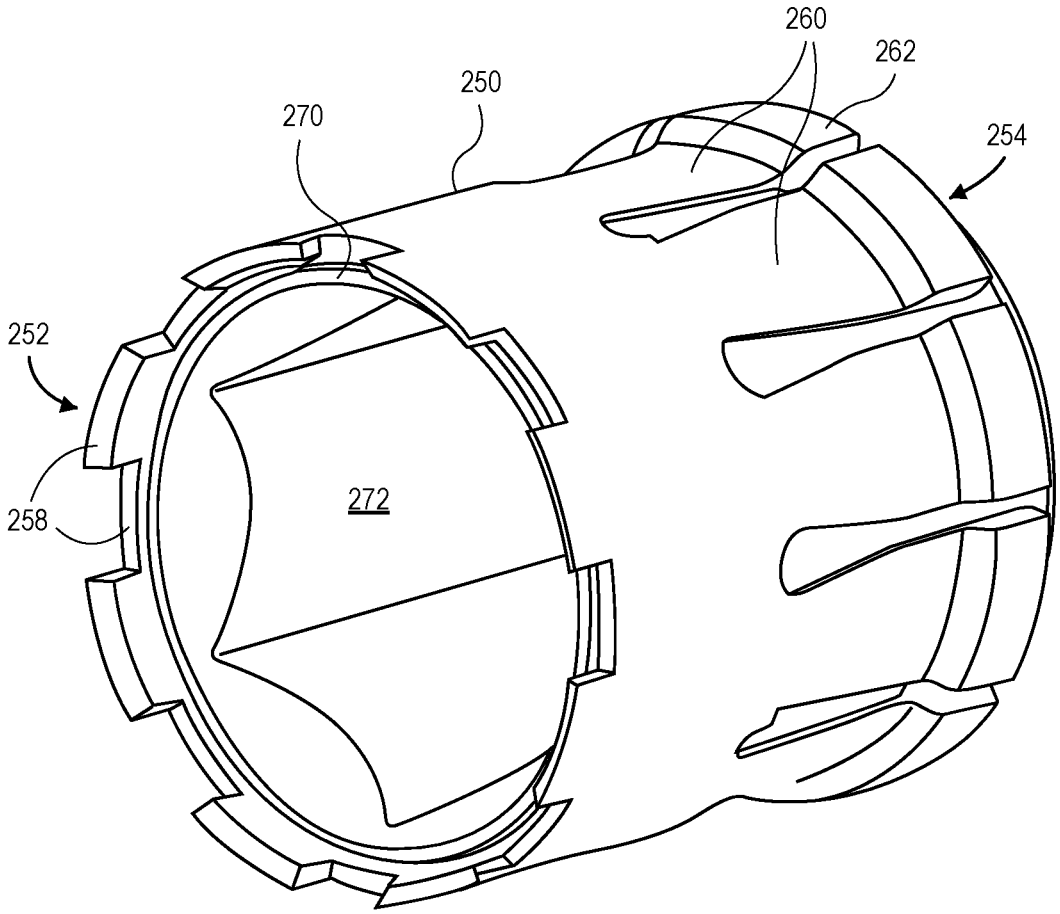
FIG. 4 illustrates a perspective view of a collet and a collet pin of the tool, according to an embodiment.

FIG. 4 illustrates a perspective view of a portion of FIG. 3, according to an embodiment. Referring to FIGS. 3 and 4, the first end 252 of the collet 250 may include one or more tool-engaging features 258. The tool-engaging features 258 may be or include a plurality of circumferentially-offset teeth that include alternating peaks and valleys. The second end 254 of the collet 250 may include a plurality of circumferentially-offset fingers 260. One or more of the fingers 260 may include a protrusion 262 that extends radially-outward therefrom. As described in greater detail below, as the collet 250 is being inserted into the body 210, the contact between the protrusions 262 and the inner surface of the body 210 may cause the fingers 260 to flex radially-inward. The inner surface of the body 210 may define a recess 220 that is configured to receive the protrusions 262. When the protrusions 262 reach the recess 220, the fingers 260 may flex radially-outward, allowing the protrusions 262 to be positioned at least partially within the recess 220. This may secure the collet 250 axially in place within the body 210.

Referring now to FIGS. 2-4, a collet pin 270 may also be positioned at least partially within the body 210 (e.g., within the bore 216). The collet pin 270 may be or include an annular member that is configured to be positioned at least partially within the collet 250. The collet pin 270 may also or instead be positioned axially-adjacent to the internal assembly 230. More particularly, as illustrated in FIGS. 2 and 3, the collet pin 270 may be positioned axially-adjacent to the adapter 240.

The collet pin 270 may include one or more tool engaging features 272. As shown, the tool-engaging feature 272 may be or include the inner surface of the collet pin 270, which may have a polygonal (e.g., square, rectangle, pentagon, hexagon, etc.) cross-sectional shape that is configured to receive a collet pin tool. In another embodiment, the tool engaging feature 272 may be or include the upstream end of the collet pin 270, which may include a plurality of circumferentially-offset teeth that include alternating peaks and valleys, similar to the tool engaging features 258 of the collet 250, but positioned radially-inward therefrom. The collet pin 270 may be rotated with respect to the collet 250 to cause outer threads 274 on the outer surface of the collet pin 270 to engage inner threads 264 on the inner surface of the collet 250. This may connect the collet 250 and the collet pin 270 together, which may secure the collet pin 270 axially in place within the body 210.

As the collet pin 270 rotates with respect to the collet 250, the collet pin 270 may move axially toward and eventually contact the adapter 240 and/or exert an axial force on the adapter 240 in the downstream direction. As described in greater detail below, the internal assembly 230 may be secured axially in place within the body 210 by/between the internal shoulder 218 of the body 210 and the collet pin 270. More particularly, the end 235 of the magnet holder 234 may be in contact with the internal shoulder 218 in the body 210, thereby preventing further downstream movement of the internal assembly 230. The adapter 240 may be in contact with the collet pin 270, which is secured axially in place within the body 210, thereby preventing further upstream movement of the internal assembly 230.

Together, the collet 250 and the collet pin 270 may help to secure the internal assembly 230 in place within the body 210 of the tool 100, while providing the axial bore 216 through the tool 100. The bore 216 may be used to pump the drilling fluid 26 through the tool 100. In another embodiment, the bore 216 may also or instead provide a path for another tool (e.g., a fishing tool) to pass through the collet 250 and the collet pin 270 to access the internal assembly 230 or a component below the tool 100 (e.g., the BHA 120).

Figure 5:
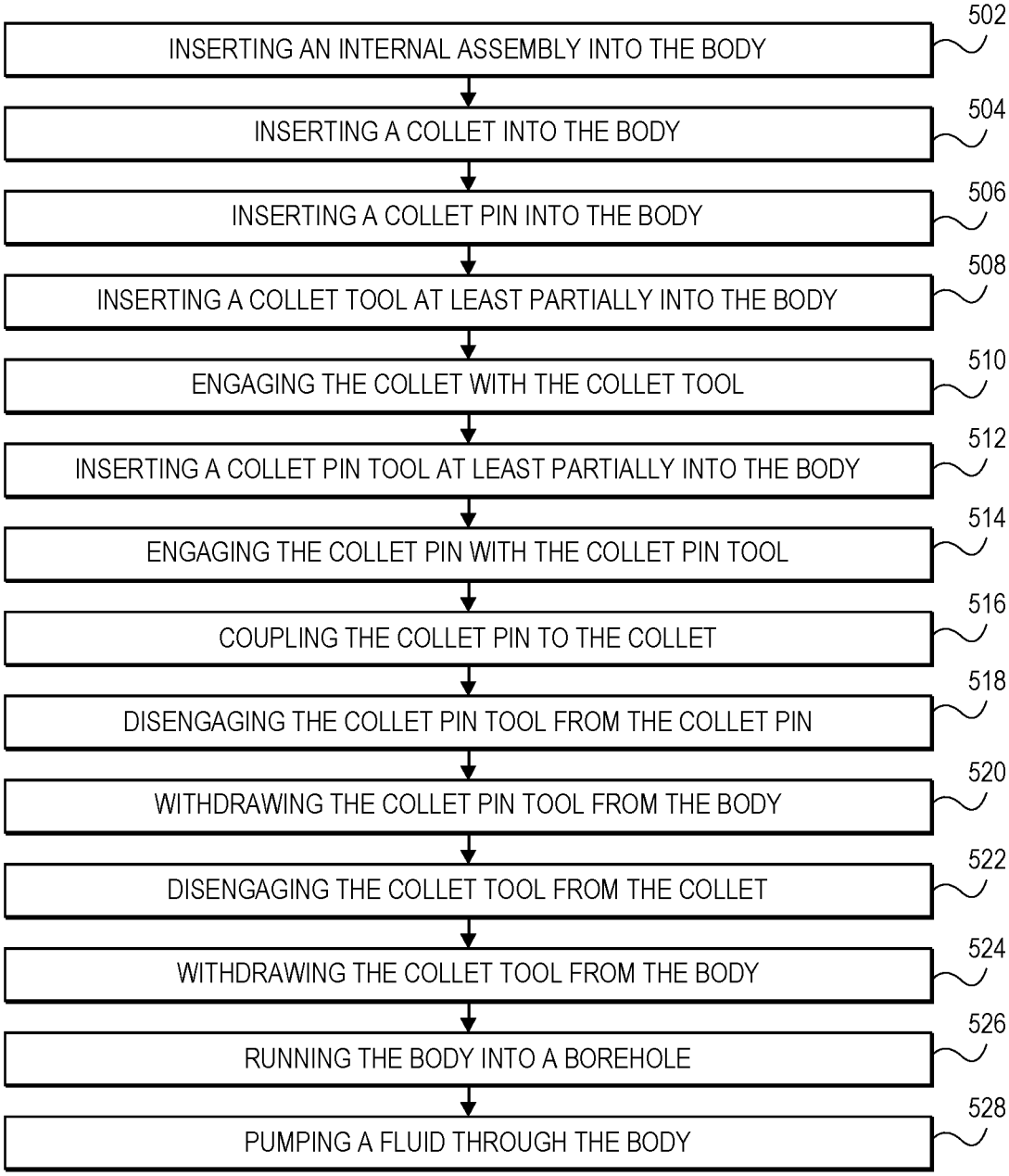
FIG. 5 illustrates a flowchart of a method for assembling the tool and/or using the tool, according to an embodiment.

FIG. 5 illustrates a flowchart of a method 500 for assembling and/or using the tool 100, according to an embodiment. For example, the method 500 may be used to secure the internal assembly 230 in the body 210. An illustrative order of the method 500 is provided below; however, as will be appreciated, one or more portions of the method 500 may be performed in a different order or omitted.

Figure 6:
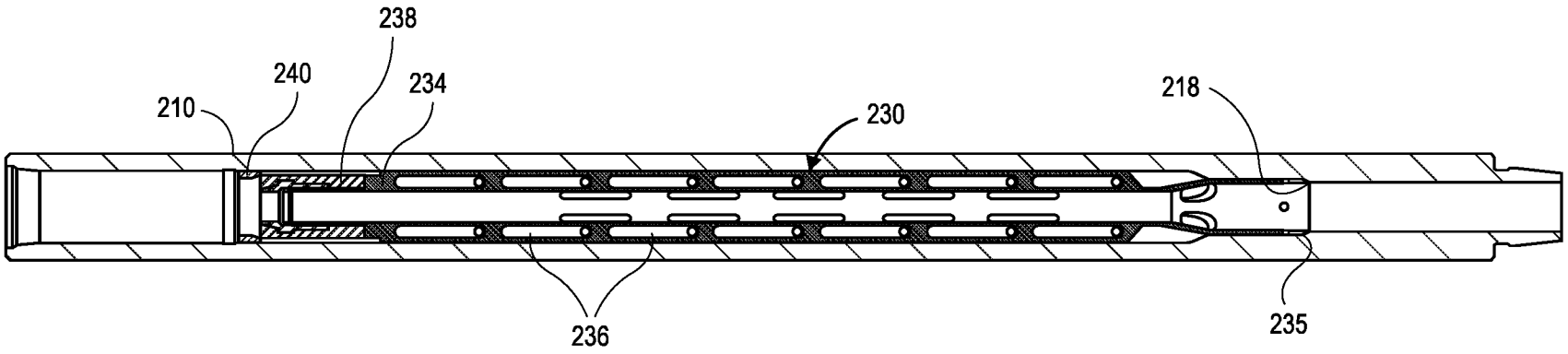
FIG. 6 illustrates a cross-sectional side view of an internal assembly positioned within a body of the tool, according to an embodiment.

The method 500 may include inserting the internal assembly 230 into the body 210 (e.g., into the bore 216), as at 502. This is shown in FIG. 6. The internal assembly 230 may be inserted until the end 235 of the magnet holder 234 contacts the internal shoulder 218 of the body 210, which may prevent further downstream movement of the magnet holder 234 within the body 210. The magnet holder 234 may be holding the magnets 236.

Figure 7:
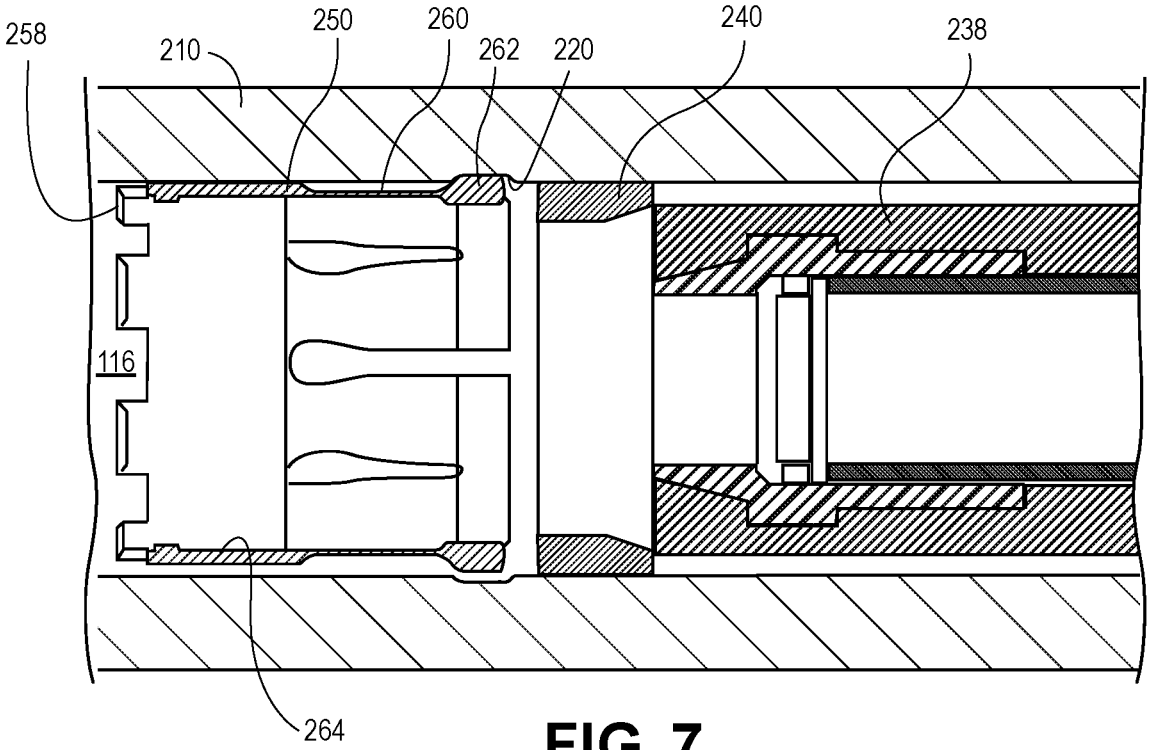
FIG. 7 illustrates a cross-sectional side view of the collet positioned within the body and axially-adjacent to the internal assembly, according to an embodiment.

The method 500 may also include inserting the collet 250 into the body 210 (e.g., into the bore 216), as at 504. This is shown in FIG. 7. The collet 250 may be inserted until the protrusions 262 are positioned at least partially within the recess 220 in the body 210. This may secure the collet 250 axially in place within the body 210. The collet 250 may be positioned axially-adjacent to the internal assembly 230 (e.g., the adapter 240). The collet 250 may be in contact with the adapter 240, or the axial gap 256 may be present between the collet 250 and the adapter 240. When the axial gap 256 is present, the internal assembly 230 may be configured to move in the upstream direction until the adapter 240 contacts the collet 250.

Figure 8:
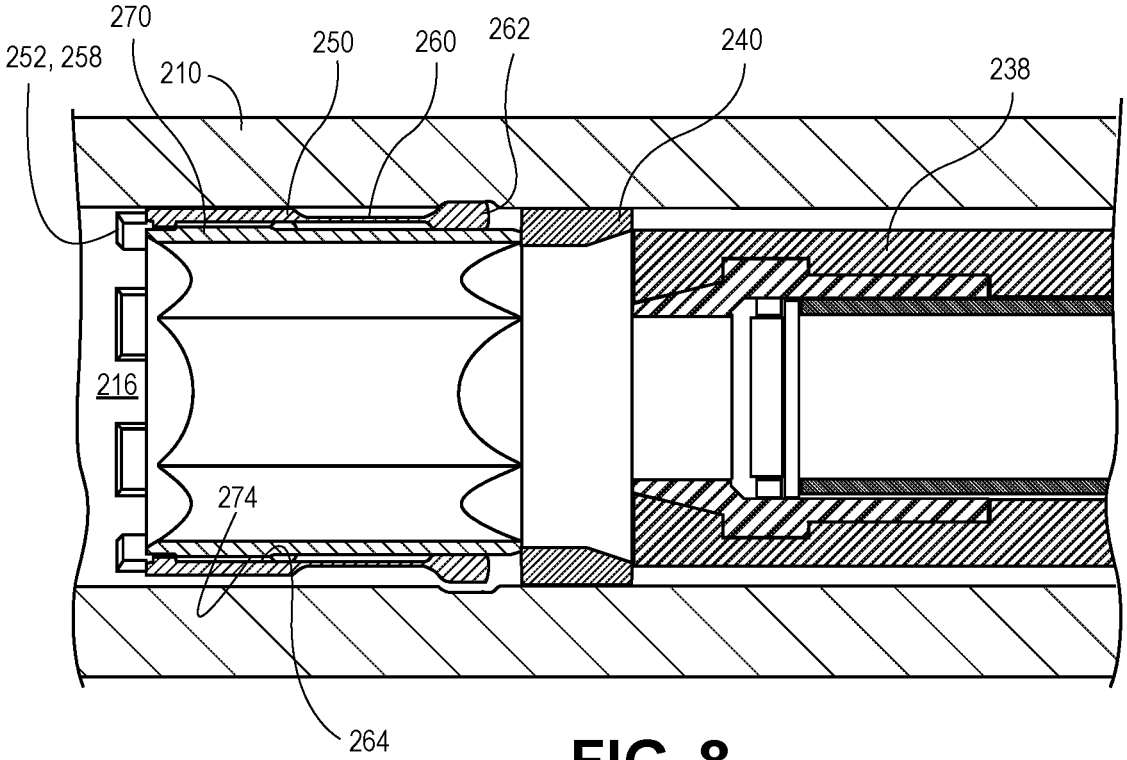
FIG. 8 illustrates a cross-sectional side view of the collet pin positioned within the body and at least partially within the collet, according to an embodiment.

The method 500 may also include inserting the collet pin 270 into the body 210 (e.g., into the bore 216), as at 506. This is shown in FIG. 8. The collet pin 270 may be positioned at least partially within the collet 250. The collet pin 270 may be positioned axially-adjacent to the internal assembly 230 (e.g., the adapter 240). In at least one embodiment, the collet pin 270 may not yet be in contact with the adapter 240 (i.e., the axial gap 256 may be present between the adapter 240 and the collet pin 270).

Figure 9:
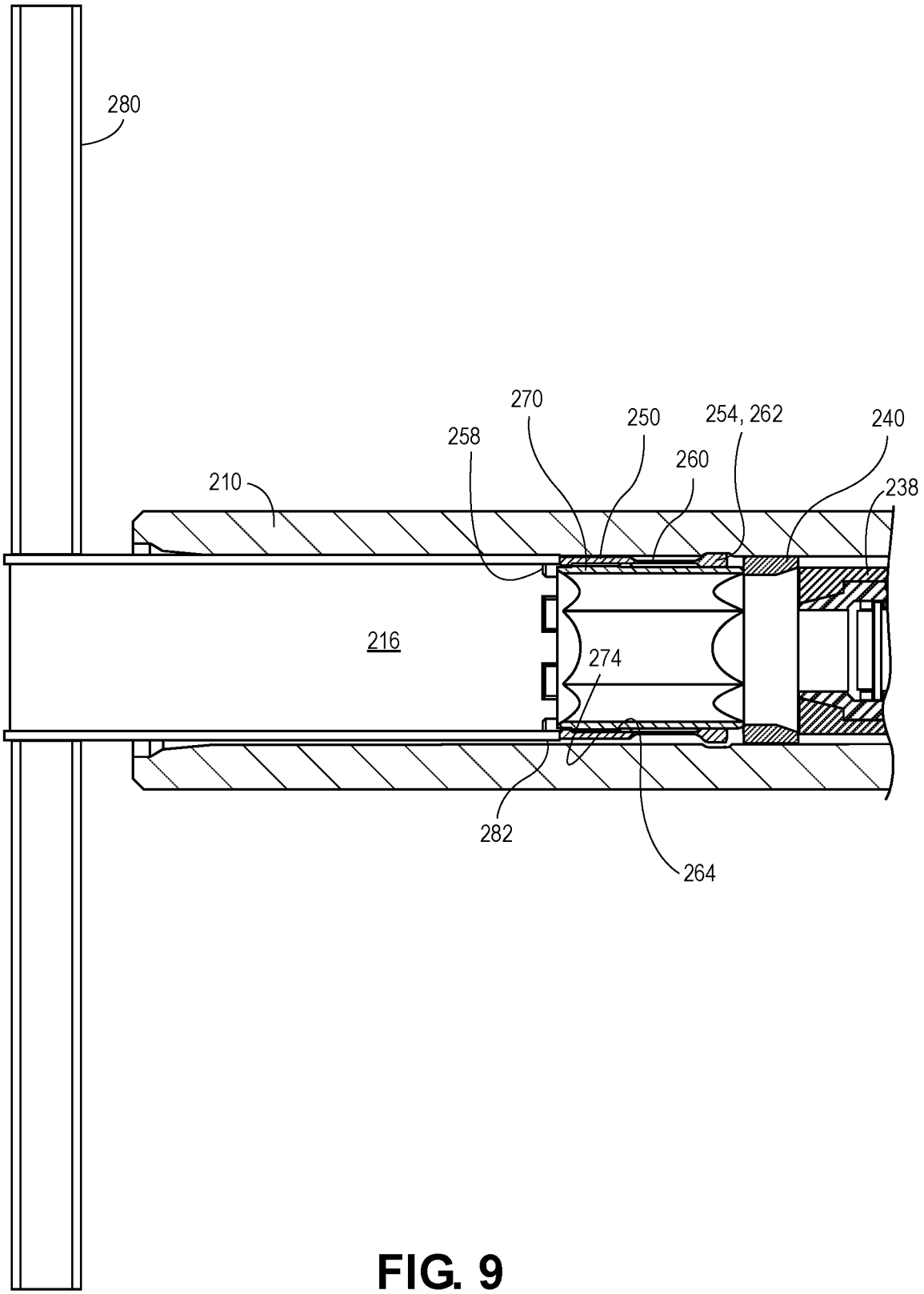
FIG. 9 illustrates a cross-sectional side view of a collet tool inserted into the body and engaging the collet, according to an embodiment.

The method 500 may also include inserting a collet tool 280 at least partially into the body 210 (e.g., into the bore 216), as at 508. This is shown in FIG. 9. The collet tool 280 may include one or more collet-engaging features 282 that are configured to engage the tool-engaging features 258 on the collet 250. The collet-engaging features 282 may be or include a plurality of circumferentially-offset teeth that include alternating peaks and valleys.

The method 500 may also include engaging the collet 250 with the collet tool 280, as at 510. This is also shown in FIG. 9. This may include engaging the tool-engaging features 258 on the collet 250 with the collet-engaging features 282 on the collet tool 280. More particularly, the peaks of the collet-engaging features 282 of the collet tool 280 may be inserted at least partially into the valleys of the tool-engaging features 258 of the collet 250. Thus, each peak of the collet tool 280 may be positioned circumferentially-between two adjacent peaks of the collet 250. In one embodiment, the collet tool 280 may be held substantially stationary to prevent the collet 250 from rotating within the body 210. In another embodiment, the collet tool 280 may be rotated to rotate the collet 250 within the body 210.

Figure 10:
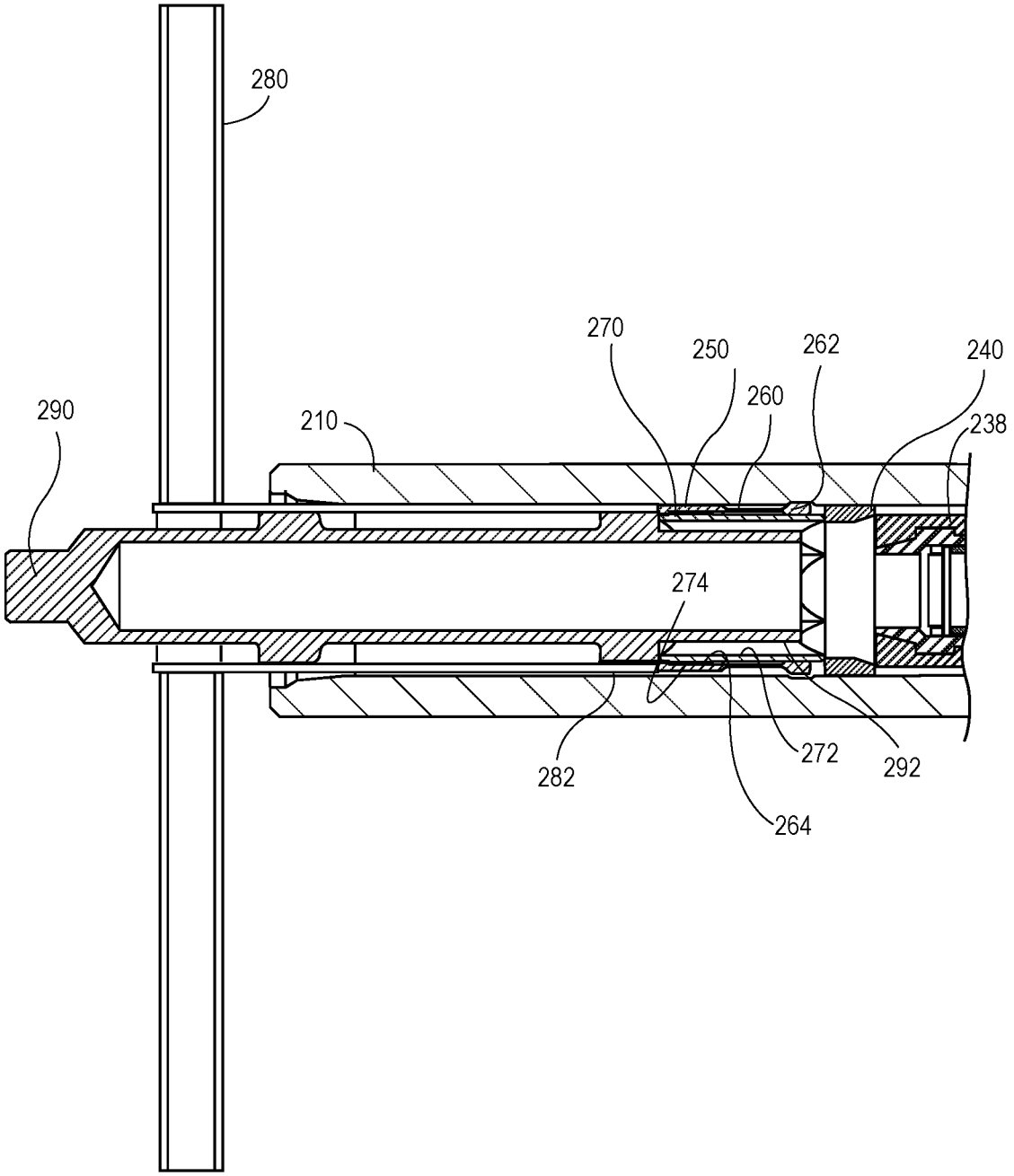
FIG. 10 illustrates a cross-sectional side view of a collet pin tool inserted into the body and engaging the collet pin, according to an embodiment.

The method 500 may also include inserting a collet pin tool 290 at least partially into the body 210 (e.g., into the bore 216), as at 512. This is shown in FIG. 10. The collet pin tool 290 may be inserted into and/or through the collet tool 280. The collet pin tool 290 may include one or more collet pin-engaging features 292 that is/are configured to engage the tool-engaging feature 272 of the collet pin 270. The collet pin-engaging feature 292 may be or include an outer surface of the collet pin tool 290 that has a substantially-polygonal (e.g., hexagonal) cross-sectional shape.

The method 500 may also include engaging the collet pin 270 with the collet pin tool 290, as at 514. This is also shown in FIG. 10. This may include engaging the tool-engaging feature 272 of the collet pin 270 with the collet pin-engaging feature 292 of the collet pin tool 290. More particularly, the polygonal outer surface of the collet pin tool 290 may contact the polygonal inner surface of the collet pin 270.

The method 500 may also include connecting the collet pin 270 to the collet 250, as at 516. In one embodiment, this may include rotating the collet pin 270 using the collet pin tool 290 while the collet 250 is substantially prevented from rotating using the collet tool 280. In another embodiment, this may instead include rotating the collet 250 using the collet tool 280 while the collet pin 270 is substantially prevented from rotating using the collet pin tool 290. In yet another embodiment, this may instead include rotating the collet 250 and the collet pin 270 in opposing directions using the collet tool 280 and the collet pin tool 290, respectively.

The relative rotation between the collet 250 and the collet pin 270 may cause the outer threads 274 of the collet pin 270 to engage the inner threads 264 of the collet 250. As mentioned above, the collet 250 is secured axially in place within the body 210 by the protrusions 262 in the recess 220. Thus, as the collet pin 270 is threaded to the collet 250, the collet pin 270 may move axially within the body 210 and/or the collet 250 in the downstream direction toward the internal assembly 230 (e.g., the adapter 240). The rotation may continue until the collet pin 270 contacts the adapter 240, which may prevent further rotation and axial movement of the collet pin 270 in the downstream direction.

At this point, the collet 250 is secured axially in place within the body 210 by the protrusions 262 in the recess 220, and the collet pin 270 is secured axially in place within the body by the threaded engagement with the collet 250. The collet pin 270 may exert an axial force on the internal assembly 230 (e.g., the adapter 240) in the downstream direction, which may secure the internal assembly 230 axially in place between the shoulder 218 of the body 210 and the collet pin 270.

The method 500 may also include disengaging the collet pin tool 290 from the collet pin 270, as at 518. This may include moving the collet pin tool 290 in the upstream direction while the collet pin 270 remains axially-stationary, as the collet pin 270 and the collet pin tool 290 are not axially-connected together. The method 500 may also include withdrawing the collet pin tool 290 from the body 210, as at 520.

The method 500 may also include disengaging the collet tool 280 from the collet 250, as at 522. This may include moving the collet tool 280 in the upstream direction while the collet 250 remains axially-stationary, as the collet 250 and the collet tool 280 are not axially-connected together. The method 500 may also include withdrawing the collet tool 280 from the body 210, as at 524.

At this point, the tool 100 is assembled. This is shown in FIG. 2, where it may be seen that the internal assembly 230, the collet 250, and the collet pin 270 are positioned within the body 210, and the collet tool 280 and the collet pin tool 290 have been removed.

Once assembled, the method 500 may also include running the tool 100 into the borehole 11, as at 526. The method 500 may also include pumping the drilling fluid 26 through the tool 100, as at 528. For example, the pump 29 may cause the drilling fluid 26 to flow down through the drill string 12 and into the bore 216 of the body 210 through the first (e.g., upstream) end 212 of the body 210. The drilling fluid 26 may flow from the first end 212 toward the second end 214. More particularly, the drilling fluid 26 may flow through the collet 250 and the collet pin 270 (which may be at least partially concentric with one another), and through or past the internal assembly 230. As the drilling fluid 26 flows through/past the magnets 236 in the internal assembly 230, the magnets 236 may attract the magnetic debris. This may separate at least a portion of the magnetic debris from the drilling fluid 26, and the magnetic debris may remain collected within the tool 100. As a result, the drilling fluid 26, with the magnetic debris separated therefrom, may be discharged from the tool 100 through the second end 214 of the body 210, and the drilling fluid 26 may then flow into the BHA 120.

As mentioned above, the collet 250 and the collet pin 270 may secure the internal assembly 230 in place while still providing the bore 216 for another tool (e.g., a fishing tool) to pass therethrough. For example, a fishing tool may be run into the bore hole 11 from the surface. The fishing tool may enter the bore 216 of the tool 100 through the first end 212. The fishing tool may then pass through the collet 250 and the collet pin 270. The fishing tool may also pass through the internal assembly 230 and the second end 214 of the body 210, allowing the fishing tool to reach a component below the tool 100 such as the BHA 120 or debris in the borehole 11 below the drill bit 122.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A tool, comprising:

an internal assembly configured to be positioned at least partially within a body;

a collet configured to be positioned at least partially within the body and axially-adjacent to the internal assembly, wherein the collet comprises a plurality of fingers that are circumferentially-offset from one another, wherein at least one of the fingers comprises a protrusion that extends radially-outward and is configured to be positioned at least partially within a recess formed in an inner surface of the body to secure the collet in place with respect to the body, wherein the fingers are positioned proximate to a first axial end of the collet, wherein the collet further comprises a tool-engaging feature proximate to a second axial end of the collet, wherein the tool-engaging feature is configured to be engaged by a collet tool, and wherein the collet further comprises inner threads on an inner surface thereof; and a collet pin configured to be positioned at least partially within the body, axially-adjacent to the internal assembly, and at least partially within the collet, wherein the collet pin comprises outer threads on an outer surface thereof that are configured to engage the inner threads of the collet to secure the collet pin in place with respect to the collet, and wherein the collet pin is configured to contact the internal assembly to secure the internal assembly in place within the body.

2. The tool of claim 1, wherein the tool-engaging feature comprises a plurality of circumferentially-offset teeth that are configured to be engaged by the collet tool to substantially prevent the collet from rotating when the outer threads of the collet pin are engaged with the inner threads of the collet.

3. The tool of claim 1, wherein an inner surface of the collet pin comprises a tool-engaging feature that is configured to receive a collet pin tool.

4. The apparatus of claim 3, wherein the tool-engaging feature is substantially hexagonal.

5. A collecting tool, comprising:

a substantially tubular body defining an axial bore, wherein the bore is configured to have a drilling fluid flow therethrough;

an internal assembly configured to be positioned at least partially within the bore, wherein the internal assembly comprises a magnet holder and a plurality of magnets positioned at least partially within the magnet holder, wherein the magnets are configured to attract magnetic debris in the drilling fluid;

a collet configured to be positioned at least partially within the bore and axially-adjacent to the internal assembly, wherein the collet comprises a plurality of fingers that are circumferentially-offset from one another, wherein at least one of the fingers comprises a protrusion that extends radially-outward and is configured to be positioned at least partially within a recess formed in an inner surface of the body to secure the collet in place with respect to the body, and wherein the collet further comprises inner threads on an inner surface thereof; and a collet pin configured to be positioned at least partially within the bore, axially-adjacent to the internal assembly, and at least partially within the collet, wherein the collet pin comprises outer threads on an outer surface thereof that are configured to engage the inner threads of the collet to secure the collet pin in place with respect to the collet, and wherein the collet pin is configured to contact the internal assembly to secure the internal assembly in place within the body, wherein the collecting tool is configured to receive the drilling fluid from a drill string and to discharge the drilling fluid to a bottom hole assembly, wherein the collet and the collet pin are at least partially concentric with one another and positioned upstream from the internal assembly in the bore, and wherein the fingers are positioned proximate to a first axial end of the collet, wherein the collet further comprises a plurality of circumferentially-offset teeth proximate to a second axial end of the collet, and wherein the teeth are configured to be engaged by a collet tool to substantially prevent the collet from rotating when the outer threads of the collet pin are engaged with the inner threads of the collet.

6. The collecting tool of claim 5, wherein an inner surface of the collet pin is configured to receive a collet pin tool, wherein the collet pin tool is configured to rotate the collet pin while the collet tool substantially prevents the collet from rotating to screw the outer threads and the inner threads together, wherein the collet moves toward and contacts the internal assembly as the outer threads and the inner threads are screwed together, and wherein the contact between the collet pin and the internal assembly secures the internal assembly in place within the bore.

7. The tool of claim 5, wherein an inner surface of the collet pin comprises a tool-engaging feature that is configured to receive a collet pin tool.

8. The apparatus of claim 7, wherein the tool-engaging feature is substantially hexagonal.

9. A method, comprising:

inserting an internal assembly into a body of a tool;

inserting a collet into the body, wherein the collet is positioned axially-adjacent to the internal assembly, and wherein a protrusion on the collet is positioned at least partially within a recess in an inner surface of the body to secure the collet in place within the body;

inserting a collet pin into the body, wherein the collet pin is positioned axially-adjacent to the internal assembly and at least partially within the collet;

inserting a collet tool at least partially into the body;

engaging the collet with the collet tool;

inserting a collet pin tool at least partially into the body, wherein inserting the collet pin tool at least partially into the body comprises inserting the collet pin tool through the collet tool;

engaging the collet pin with the collet pin tool; and connecting the collet pin to the collet, using the collet tool and the collet pin tool, to secure the collet pin in place within the body.

10. The method of claim 9, wherein connecting the collet pin to the collet comprises engaging inner threads on an inner surface of the collet with outer threads on an outer surface of the collet pin.

11. The method of claim 10, wherein connecting the collet pin to the collet comprises rotating the collet pin using the collet pin tool while substantially preventing the collet from rotating using the collet tool.

12. The method of claim 11, wherein rotating the collet pin causes the collet pin to move axially-toward and contact the internal assembly.

13. The method of claim 12, wherein the collet pin contacting the internal assembly secures the internal assembly in place between the collet pin and an internal shoulder of the body.

14. The method of claim 9, wherein engaging the collet with the collet tool comprises engaging a plurality of circumferentially-offset teeth on an axial end of the collet with the collet tool, and wherein the method further comprises:

disengaging the collet tool from the collet after the collet pin is connected to the collet; and withdrawing the collet tool from the body.

15. The method of claim 14, wherein engaging the collet pin with the collet pin tool comprises engaging a polygonal inner surface of the collet pin with a polygonal outer surface of the collet pin tool, and wherein the method further comprises:

disengaging the collet pin tool from the collet pin; and withdrawing the collet pin tool from the body.

16. The method of claim 9, wherein the internal assembly comprises a magnet holder and a plurality of magnets, and wherein the method further comprises:

running the tool into a borehole, while the body has the internal assembly, the collet, and the collet pin positioned therein; and pumping a drilling fluid through the body while the body is positioned within the borehole, wherein the magnets are configured to attract magnetic debris in the drilling fluid to prevent the magnetic debris from flowing into a bottom hole assembly that is connected to and positioned downstream from the body.

17. The method of claim 16, further comprising running a fishing tool into the borehole, through the body, the internal assembly, the collet, and the collet pin to reach a component positioned below the tool.

* * * * *